US011812905B2

(12) United States Patent
Ciavarella

(10) Patent No.: US 11,812,905 B2
(45) Date of Patent: Nov. 14, 2023

(54) PUMPS WITH POSITIVE PRESSURE VENTING, REFILL UNITS AND DISPENSERS

(71) Applicant: GOJO Industries, Inc., Akron, OH (US)

(72) Inventor: Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/626,534

(22) PCT Filed: Jul. 24, 2020

(86) PCT No.: PCT/US2020/043371
§ 371 (c)(1),
(2) Date: Jan. 12, 2022

(87) PCT Pub. No.: WO2021/016507
PCT Pub. Date: Jan. 28, 2021

(65) Prior Publication Data

US 2022/0400908 A1 Dec. 22, 2022

Related U.S. Application Data

(60) Provisional application No. 62/878,446, filed on Jul. 25, 2019.

(51) Int. Cl.
*A47K 5/14* (2006.01)
*B05B 7/00* (2006.01)
(Continued)

(52) U.S. Cl.
CPC ..... *A47K 5/14* (2013.01); *B05B 7/0025* (2013.01); *B05B 11/047* (2013.01); *B05B 11/1087* (2023.01)

(58) Field of Classification Search
CPC ..... B65D 83/546; B65D 83/752; A61F 9/008; B05B 7/241; B05B 7/2418; B05B 7/2424; B05B 7/2467; B05B 1/12
(Continued)

(56) References Cited

U.S. PATENT DOCUMENTS 5,222,633 A 6/1993 Blake
7,303,099 B2 12/2007 Ophardt
(Continued)

FOREIGN PATENT DOCUMENTS

EP 2929946 A1 10/2015
WO 2009142886 A1 11/2009

OTHER PUBLICATIONS

International Search Report and Written Opinion from PCT/US20/43371 dated Oct. 30, 2020, 15 pages.

*Primary Examiner* — Vishal Pancholi
(74) *Attorney, Agent, or Firm* — Calfee, Halter & Griswold LLP

(57) ABSTRACT

Exemplary embodiments of pumps having positive pressure venting and refill units are disclosed herein. An exemplary pump includes a liquid pump chamber, a liquid piston, a first air pump chamber, and a first air piston and a mixing area in fluid communication with the liquid pump chamber and the first air pump chamber. The exemplary pump further includes a second air pump chamber and a second air pump piston. The second air pump chamber is configured for pumping air into a container and the first air piston and the second air piston move in unison.

20 Claims, 3 Drawing Sheets

(51) Int. Cl.
*B05B 11/04* (2006.01)
*B05B 11/10* (2023.01)

(58) Field of Classification Search
USPC ..... 222/491
See application file for complete search history.

(56) References Cited

U.S. PATENT DOCUMENTS

| | | | |
|---|---|---|---|
| 7,611,030 | B2 | 11/2009 | Reynolds et al. |
| 7,621,426 | B2 | 11/2009 | Reynolds et al. |
| 7,837,066 | B2 | 11/2010 | Reynolds et al. |
| 7,909,209 | B2 | 3/2011 | Reynolds et al. |
| 8,091,739 | B2 | 1/2012 | Ophardt et al. |
| 8,113,388 | B2 | 2/2012 | Ophardt et al. |
| 8,172,555 | B2 | 5/2012 | Reynolds |
| 8,272,539 | B2 | 9/2012 | Ophardt et al. |
| 8,272,540 | B2 | 9/2012 | Ophardt et al. |
| 8,360,286 | B2 | 1/2013 | Shi et al. |
| 8,464,912 | B2 | 6/2013 | Ophardt et al. |
| 8,960,498 | B2 | 2/2015 | Wegelin et al. |
| 9,172,266 | B2 | 10/2015 | Curtis et al. |
| 10,080,466 | B2 | 9/2018 | Ciavarella et al. |
| 10,080,467 | B2 | 9/2018 | Ciavarella et al. |
| 2005/0276707 | A1 | 12/2005 | Ophardt |
| 2008/0083784 | A1 | 4/2008 | Foster et al. |
| 2008/0277421 | A1 | 11/2008 | Zlatic et al. |
| 2013/0032614 | A1 | 2/2013 | Babikian et al. |
| 2014/0076924 | A1 | 3/2014 | Liang et al. |
| 2015/0144661 | A1 | 5/2015 | Tepas et al. |
| 2015/0173568 | A1 | 6/2015 | Harris et al. |
| 2015/0320651 | A1 | 11/2015 | Matthews et al. |
| 2016/0029855 | A1 | 2/2016 | Harris et al. |
| 2017/0027391 | A1 | 2/2017 | Jones et al. |

PUMPS WITH POSITIVE PRESSURE VENTING, REFILL UNITS AND DISPENSERS

RELATED APPLICATION

The present application is the U.S. national stage entry of International Application No. PCT/US2020/043371, filed Jul. 24, 2020, which claims the benefits of, and priority to, U.S. Provisional Patent Application Ser. No. 62/878,446, filed Jul. 25, 2019, the entire contents of which are incorporated herein by reference.

TECHNICAL FIELD

The present invention relates generally to pumps, refill units for dispensers, and dispensers, and more particularly to pumps having positive pressure venting, refill units and dispensers that utilize such pumps.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Many dispensers are refillable with refill units that comprise a pump (e.g. a liquid pump, or a foam pump, i.e. a pump that pump liquid and air) and a container. In some systems, as liquid is pumped out of the container, the container is designed to collapse due to the vacuum pressure created in the container from pumping the fluid out. In some systems, a vent is provided to prevent the container from collapsing. Once a set vacuum pressure is reached in the container, the vent opens and allows air to be drawn into the container. These venting systems may be prone to partial collapsing of the container if the cracking pressure is near the collapsing vacuum pressure of the container, or the vent valve sticks. To avoid collapsing, or partial collapsing, of the container, the container needs to be made with thicker walls.

SUMMARY

Exemplary embodiments of pumps having positive pressure venting and refill units are disclosed herein. An exemplary pump includes a liquid pump chamber, a liquid piston, a first air pump chamber, and a first air piston and a mixing area in fluid communication with the liquid pump chamber and the first air pump chamber. The exemplary pump further includes a second air pump chamber and a second air pump piston. The second air pump chamber is configured for pumping air into a container and the first air piston and the second air piston move in unison.

Another exemplary pump includes a liquid pump chamber, a liquid piston, a liquid outlet, an air pump chamber, a vent valve and an air pump piston. The air pump chamber and the liquid pump chamber have about the same volume. The liquid piston and the air pump piston are connected together. The vent valve has a cracking pressure of less than 0.6 psi. The pump is configured to vent a container through positive pressure when the air pump piston compressed the volume of the air pump chamber and through vacuum pressure in a container causing the vent valve to open and allow air to flow into the container.

An exemplary refill unit includes a container and a pump secured to the container. The pump has a liquid pump chamber, a liquid pump piston, a first air pump chamber, a first air pump piston and a mixing area located downstream of the liquid pump chamber and the first air pump chamber for receiving liquid from the liquid pump chamber and air from the first air pump chamber. An outlet is located downstream of the mixing area for dispensing a liquid and air mixture. The pump includes a second air pump chamber, a second air pump piston, and a vent valve secured to the second air pump chamber. The second air pump chamber has a volume that is about the same volume as the liquid pump chamber and the second air pump chamber pumps air into the container.

BRIEF DESCRIPTION OF THE DRAWINGS

These and other features and advantages of the present invention will become better understood with regard to the following description and accompanying drawings in which.

DETAILED DESCRIPTION

Figure 1:
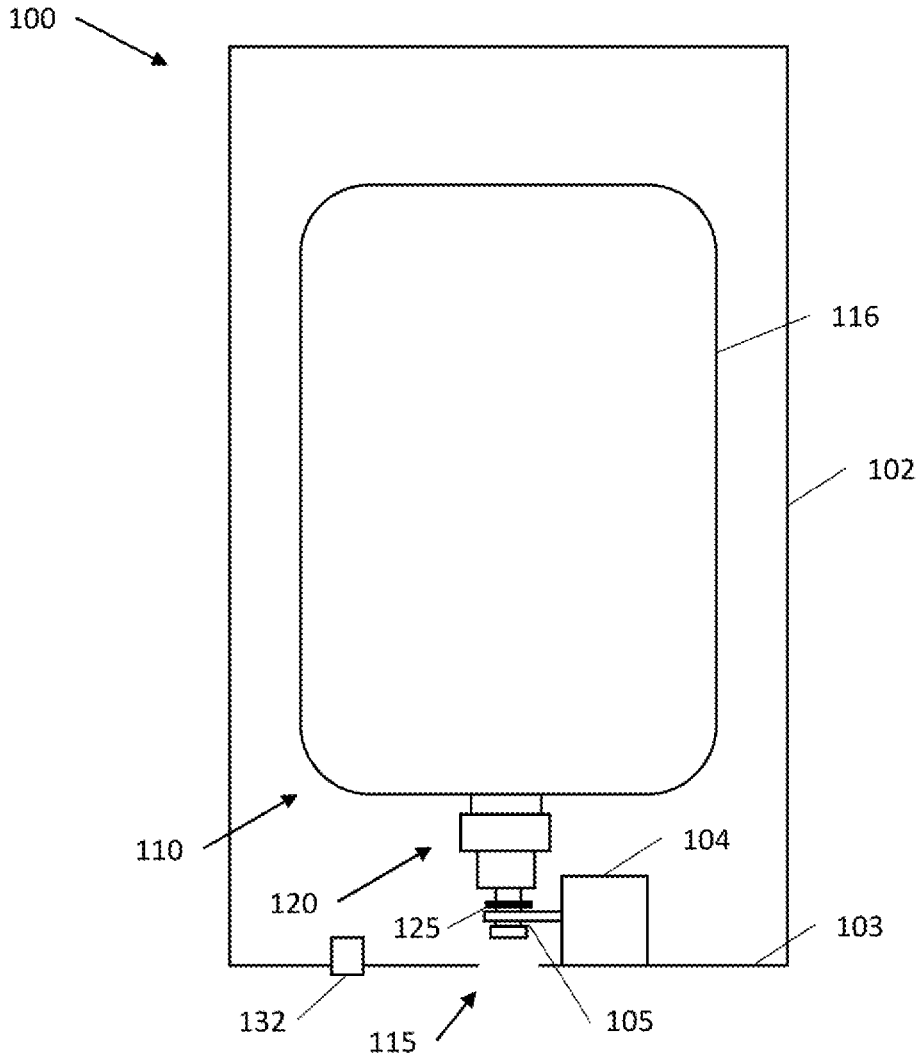
FIG. 1 is a cross-section of an exemplary liquid dispenser having a refill unit with a pump having a positive pressure vent.

FIG. 1 illustrates an exemplary embodiment of a dispenser 100. The cross-section of FIG. 1 is taken through the housing 102 to show the refill unit 110, which is made up of pump 120 and container 116. In various embodiments, the dispenser 100 is a "touch free" dispenser and includes an actuator 104 that activates the pump 120 to pump liquid from the container 116 and out of the nozzle 115 of the dispenser 100.

Exemplary touch-fee dispensers are shown and described in U.S. Pat. No. 7,837,066 titled Electronically Keyed Dispensing System And Related Methods Utilizing Near Field Response; U.S. Pat. No. 9,172,266 title Power Systems For Touch Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hans-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all which are incorporated herein by reference. In embodiments that include a touch-free feature, the dispenser 100 may include a power source (not shown), a sensor (not shown), a controller (not shown), and a motor (not shown). The power source is in electrical communication with and provides power to the sensor, controller, and motor. The power source may be an internal power source, such as, for example, one or more batteries or an external power source, such as, for example, solar cells, or a conventional 120 VAC power supply. In some embodiments, a multiple power supplies are included, such as, for example, batteries and solar cells.

Dispenser 100 includes a disposable refill unit 110. The disposable refill unit 110 includes a container 116 connected to pump 120. Pump 120 does not need to be used with a disposable refill unit and may be used with non-disposable containers or refillable containers. The dispenser 100 may be a wall-mounted system, a counter-mounted system, an unmounted portable system movable from place to place or the like. In this exemplary embodiment, dispenser 100 is a foam dispenser and the exemplary embodiments described herein have foam pumps that contain a liquid pump portion and an air pump portion; however, the inventive venting system described herein works equally well with a liquid pump that does not include an air pump portion. In some alternative embodiments that are liquid pumps, the air vent pump is positioned in the area illustrated in the exemplary embodiments for pumping air to mix with liquid. In such embodiment, a positive pressure vent valve is used to direct the air from the vent pump into the container.

Exemplary embodiments of foam pumps are shown and described in, U.S. Pat. No. 7,303,099 titled Stepped Pump Foam Dispenser; U.S. Pat. No. 8,002,150 titled Split Engagement Flange for Soap Piston; U.S. Pat. No. 8,091,739 titled Engagement Flange for Fluid Dispenser Pump Piston; U.S. Pat. No. 8,113,388 titled Engagement Flange for Removable Dispenser Cartridge; U.S. Pat. No. 8,272,539, Angled Slot Foam Dispenser; U.S. Pat. No. 8,272,540 titled Split Engagement Flange for Soap Dispenser Pump Piston; U.S. Pat. No. 8,464,912 titled Split Engagement Flange for Soap Dispenser Pump Piston; U.S. Pat. No. 8,360,286 titled Draw Back Push Pump; U.S. Pat. No. 10,080,467 titled High Quality Non-Aerosol Hand Sanitizing Foam; U.S. Pat. No. 10,080,466 titled Sequentially Activated Multi-Diaphragm Foam Pumps, Refill Units and Dispenser Systems; U.S. Pat. No. 8,172,555 titled Diaphragm Foam Pump; U.S. 2008/0,277,421 titled Gear Pump and Foam Dispenser, all of which are incorporated herein by reference in their entirety. These exemplary foam pumps may be converted to liquid pumps by removing the air pump components and/or moving the positive pressure vent pump portion into the air compressor portion.

The container 116 forms a liquid reservoir that contains a supply of a liquid within the disposable refill unit 110. In various embodiments, the contained liquid could be, for example, a soap, a sanitizer, a cleanser, a disinfectant or some other liquid that may be foamable or not foamable (in the case of a liquid only pump). In the exemplary disposable refill unit 110, the container 116 can be made of thin plastic or like material. The container is non-collapsible and a positive pressure vent is used to force air into container 116 when liquid is pumped out of container 116. The container 116 may advantageously be refillable, replaceable or both refillable and replaceable. By using a positive pressure venting system as shown and described herein, the walls of container 116 may be made of a thinner plastic, thereby upping the sustainability of the product. In addition, using less plastic material reduces the costs associated with producing and recycling the container 116.

In the event the liquid stored in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air or foam through the pump 120. Actuator 104 is generically illustrated because there are many different kinds or types of pump actuators which may be employed in the foam dispenser 100. Exemplary dispenser 100 is an electronic touch-free dispenser and automatically dispenses a dose of fluid on a user's hands when the user places her hand beneath the dispenser outlet. In some embodiments, the dispenser is a manual dispenser.

The actuator 104 of the foam dispenser 100 may be any type of actuator such as, for example, a manual lever, a manual pull bar, a manual push bar, a manual rotatable crank if the dispenser is a manual dispenser, or an electrically activated actuator or other means for actuating the pump 120 for touch-free dispensers. Electronic touch-free dispenser may additionally include a sensor 132 for detecting the presence of an object e.g. a hand and to provide for a hands-free dispenser system with touchless operation. Various intermediate linkages, such as for example linkage 105, may be used to connect the actuator member 104 to the pump 120 within the system housing 102. An aperture 115 is located in bottom plate 103 of housing 102 and allows fluid dispensed from the nozzle 125 of pump 120 to be dispensed to a user.

Figure 2:
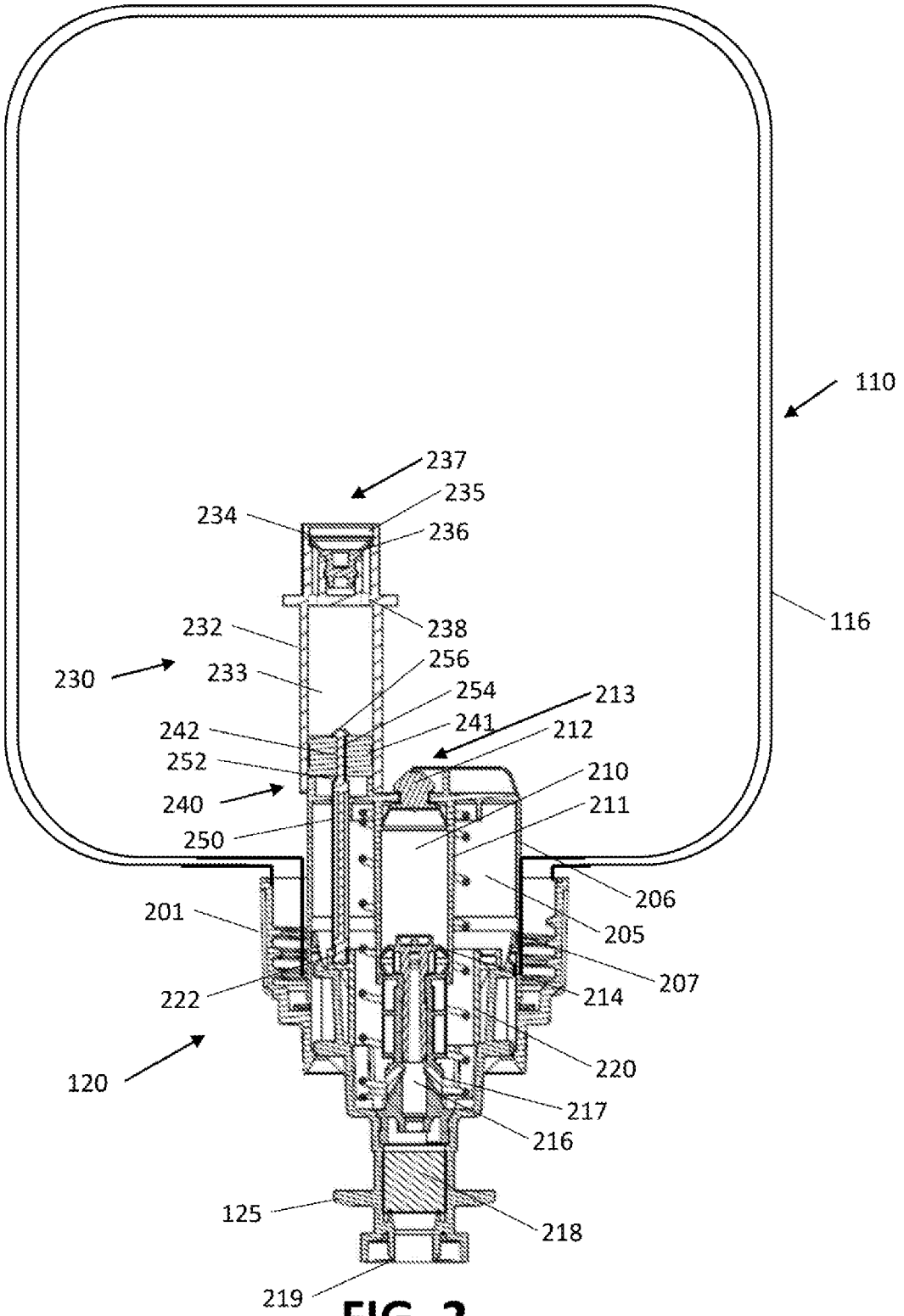
FIG. 2 is a cross-section of an exemplary refill unit with a pump having a positive pressure vent.

FIG. 2 is a cross-section of an exemplary refill unit 110 with a pump 120 having a positive pressure vent system 230. Refill unit 110 includes a container 116. Container 116 includes a neck 117. Pump 120 has a closure 201 that connects to the neck 117. In this exemplary embodiment, closure 201 connects to neck 117 with a threaded connection, however, other types of connections may be used, such as, for example, a snap fit connection, a friction fit connection or the like. Pump 120 has an outer housing 206 that partially forms an air pump chamber 205. In some embodiments, a different portion of the housing partially forms the air pump chamber 205. Moving reciprocally within the air pump chamber 205 is an air pump piston 207 to expand and contract the volume of air pump chamber 205. Pump 120 includes a liquid pump chamber 210 formed in part by liquid pump chamber wall 211 and liquid inlet valve 212. Liquid piston 214 reciprocates within liquid pump chamber 210 to expand and contract the volume of liquid pump chamber. As the liquid piston 214 and air piston 207 move upward, liquid flows past the wiper seal on the liquid piston 214 and through an opening 215 into the central passageway 216 of the liquid piston 214. Simultaneously, air flows from air pump chamber 205 through passageway 217 and into the central passageway 216 of liquid piston center 214. The air and liquid mix in the central passageway and flow through foam cartridge 218. In some embodiments, foam cartridge 218 is one or more screens. In some embodiments, foam cartridge 218 is two screens separated by a space therebetween. In some embodiments, foam cartridge 218 includes a sponge. In some embodiments, foam cartridge 218 includes one or more screens and one or more sponges. Additional exemplary embodiments of foam cartridges 218 are shown and described in U.S. Publication No. 2014/0367419 titled Foam Cartridges, Pump, Refill Units and Foam Dispensers Utilizing The Same, which is incorporated herein by reference in its entirety. If an embodiment is a liquid pump and not a foam pump, the foam cartridge 218 may be removed.

Pump 120 includes a positive pressure vent system 230. In this exemplary embodiment, the positive pressure vent system 230 includes a housing 232 that forms part of a vent pump chamber 233. In this exemplary embodiment, housing 232 has a cylindrical shape, however, other shapes may be used for the housing. Located at one end of the vent pump chamber 233 is a one way valve 234. The end of the vent pump chamber 233 includes a valve retaining member 321. In this exemplary embodiment, the valve retaining member 321 includes a base 322. Base 322 includes one or more openings 238 therethrough that allows air to flow past base 322. One way valve 234 is located within a cylindrical end portion 320 of housing 232 with an interior sidewall 235. In addition, in this embodiment, base 322 includes an annular projecting member 324 that engages with one-way valve 234 to hold it in place. Other means may be used to secure the one-way valve 234 in place.

In this exemplary embodiment, the air outlet 237 of the venting system 240 is located above the liquid inlet 213 for the liquid pump chamber 210. Positioning the air outlet 237 above the liquid inlet 213 causes air to flow up from the air outlet 237 and prevents air from being sucked into the liquid inlet 213.

In this exemplary embodiment, one-way valve 234 is a wiper seal valve that has a seal 236 that engages interior wall 235 and allows air to pass through into the container, but prevents liquid and/or air from flowing out of the container 116. Other types of one-way valves may be used provided that the one-way vale is capable of allowing air to flow out of the vent pump chamber 233 into the container 116 and prevent liquid and/or air from flowing out of the container into the vent pump chamber 233. Some exemplary one-way valves that may be used include, for example, a flap valve, a mushroom valve, a poppet valve, a disk valve, a ball and spring valve, a duck bill valve and the like.

An air vent piston 240 reciprocates back and forth in air vent pump chamber 233. Air vent piston 240 has a piston stem 250 that is connected to or linked to the air piston 207 that pumps air to mix with the liquid to form foam. Accordingly, when air piston 207 reciprocates back and forth, air vent piston 240 moves along with the air piston 207 to compress and expand vent pump chamber 233.

In this exemplary embodiment, air vent piston 240 includes a shuttle valve 241. Shuttle valve 241 has a hollow passage 252 that fits loosely over a reduced diameter portion 242 of piston stem 250. Piston stem 250 has a shuttle stop 252 and a valve retaining member 256. In this exemplary embodiment, both the shuttle stop 252 and valve retaining member 256 are larger than the diameter of the hollow passage 252. In this exemplary embodiment, a plurality of optional slits 255 extend along the top of shuttle valve 241, to ensure an air flow path around valve retaining member 256.

In this exemplary embodiment, the air vent piston 240 is connected to the air pump piston 207. In addition, in this embodiment, the air pump piston is connected to the liquid pump piston 214. In some embodiments, one or more of the pistons 240, 207, 214 are not connected to the other pistons and are moved by a separate actuator (not shown). In this exemplary embodiment, air flowing into air vent chamber 233 is sourced from air pump chamber 205. In some exemplary embodiments, air flowing into air vent chamber 233 travels through a path or conduit (not shown) and not from air pump chamber 205. The path or conduit (not shown) may connect toe air vent chamber 233 to atmospheric air by running outside of housing 206 to a closure 201, or on the outside of air pump piston 207.

Figure 4:
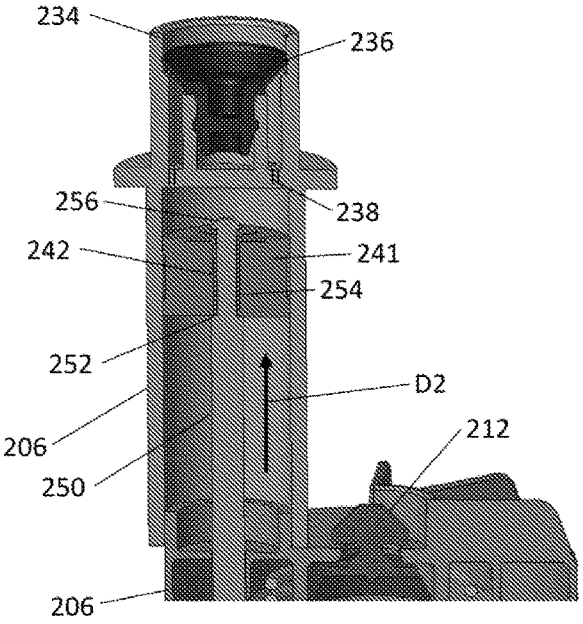

When piston stem 250 moves in direction D2 to reduce the volume of air vent pump chamber 233, shuttle valve 241 engages the shuttle stop 252 and seals the end of hollow passage 252 (as shown in FIG. 4) preventing air from flowing passed the shuttle valve 241. Accordingly, as the piston 240 continues to move in direction D2, the air in pump vent chamber 240 is compressed and is forced to flow past one-way valve 234 and into the container 116.

Figure 3:
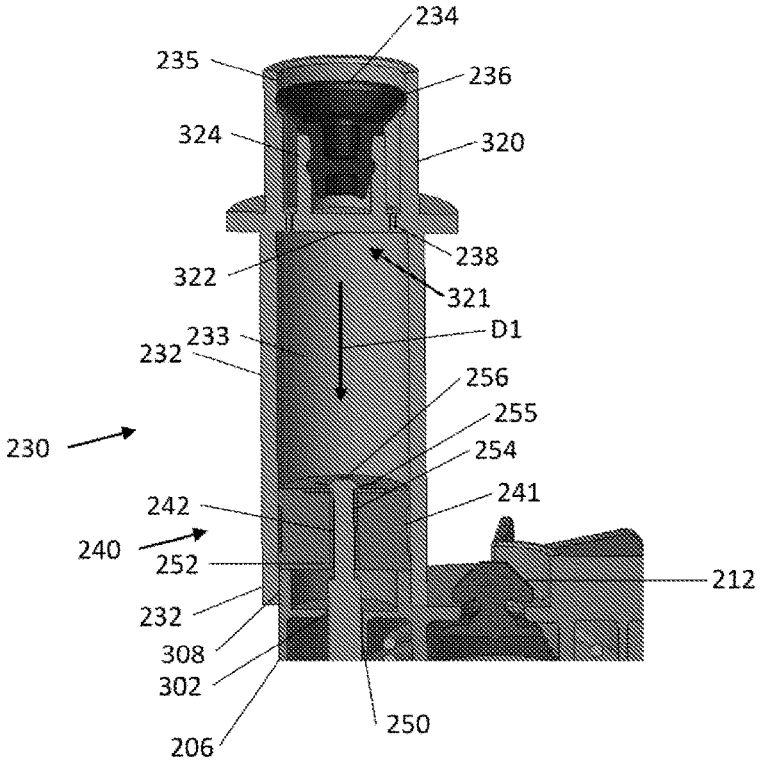
FIGS. 3 and 4 are larger cross-sectional views of the container pump having a positive pressure vent.

When piston stem 250 moves in direction D1 to expand vent pump chamber 233, bottom of shuttle valve 241 moves off of shuttle stop 252 allowing air to flow into the hollow passageway 252 (as shown in FIG. 3) and into air pump vent chamber 240. Air flows past the retaining member 256 and into pump vent chamber 240. Air may flow past retaining member 256 in any number of ways, such as for example, optional slits or slots (not shown) in retaining member 256, optional slotted openings or slits 255 in the top of shuttle valve 252, retaining member 256 may be oval shaped, or other various configurations that allow retaining member 256 to retain shuttle valve 241 while allowing air to flow past.

In this exemplary embodiment, a shuttle valve 252 is shown and described. The shuttle valve 252 is preferred in some embodiments as the shuttle valve provides minimal, if any, resistance to air flowing into the air vent pump chamber 233 as the air vent piston stem 250 moves in direction D1 and does not have a cracking pressure, i.e. a required vacuum pressure in the air vent pump chamber to open the valve 252. Other types of valve members or combinations of one-way valve members may be used. For example, a flap valve, a poppet valve, a duck-bill valve, a disk valve, a mushroom valve, a ball and spring valve or the like may be used. Preferably, the valve is one that has a low cracking pressure, or one that is opened by movement of the piston 250 as shown, so that less force is exerted on the one-way valve 234 during charging of the vent pump chamber 233.

Preferably the size of the liquid pump chamber 210 and the vent pump chamber 233 are the same or substantially the same. Accordingly, each time the pump is cycled, the volume of liquid removed from the container is the same as the volume of air pumped into the container 116. In some embodiments, the volume of the vent pump chamber 233 is larger than the volume of the liquid pump chamber 210 and the container becomes slightly pressurized over time.

In some embodiments, the piston 240 is configured so that vent pump chamber 233 has a maximum pumping pressure. In other words, if the pressure in the container causes the pressure in the vent pump chamber 233 to exceed a set level, the vent pump chamber 233 pressure is released back into the air pump chamber 205 and/or out of the pump chamber. This may be accomplished through the design of the shuttle valve 241 or other valve that is used. In some embodiments, this may be accomplished by adding a pressure relief valve, such as, for example, an additional one-way valve (not shown) in the vent pump chamber 233 that has a cracking pressure that is set at the maximum container pressure. In this way, enough air may be pumped into the container to prevent the container from collapsing due to vacuum pressure, while not over pressurizing the container, which may result in liquid leaking out of the container, or may cause the pump to lock up, or use excessive energy to operate. In some embodiments, the shuttle valve 242 has a rib (not shown) around its outside diameter that contacts the interior wall of housing 233. The rib (not shown) may be sized or selected such that if a set pressure is reached in air vent pump chamber 233, the rib deflects and air flows out of air vent pump chamber around the outside of shuttle valve 242.

Preferably the vent pump chamber 233 volume is equal to the liquid pump chamber volume 210. In some embodiments, however, the volume of the vent pump chamber 233 is slightly smaller than the volume of the liquid pump chamber 210. Accordingly, each time the pump dispenses a volume of liquid from the container, a slightly smaller volume of air may be pumped from the air vent pump chamber 233 into the container 116. As a result, after a period of time, a vacuum pressure may develop in the container 116. If the vacuum pressure becomes greater than the cracking pressure of one-way valve 236, one way valve 236 may open and allow air in the vent pump chamber 233 to be drawn into the container due to the vacuum pressure.

In this exemplary embodiment, the shuttle valve 241 would be in the position illustrated in FIG. 3, when liquid is being drawn into the liquid pump chamber 210 which allows air to flow from the air pump chamber 205 into the vent pump chamber 233. When the liquid is being drawn out of the container, the vacuum pressure would be at its greatest allowing air to be pulled into the container through vacuum pressure. Thus, in some embodiments, the positive pressure vent system is a duel venting system, i.e. the system is configured to positively force air into the container and also passively allow air to be drawn into the container through vacuum pressure. In some embodiments, this dual venting system, i.e. the positive pressure venting and a vacuum actuated vent is preferred as it prevents the vent valve from sticking and causing bottle collapse (or partial collapse) because the positive pressure venting forces the vent valve to open each time the pump is cycled. The exemplary embodiments illustrated herein are configured for a dual venting system as the valve 236 will allow positive pressure in the vent pump chamber 233 to open the valve 236 and will open under vacuum pressure in the container 116 if the vacuum pressure is high enough. Accordingly, it is unlikely that the vent valve would stick and prevent vacuum pressure inside the container from opening the vent valve. This system also reduces the risk of over pressurizing the container.

In some embodiments the vent valve has a cracking pressure of less than 1 pound per square inch ("psi"). In some embodiments, the vent valve has a cracking pressure of less than 0.8 psi. In some embodiments, the vent valve has a cracking pressure of less than 0.7 psi. In some embodiments, the vent valve has a cracking pressure of less than 0.6 psi. In some embodiments, the vent valve has a cracking pressure of less than 0.5 psi. In some embodiments, the vent valve has a cracking pressure of less than 0.4 psi. In some embodiments, the vent valve has a cracking pressure of less than 0.3 psi. In some embodiments, the vent valve has a cracking pressure of less than 0.2 psi. In some embodiments, the vent valve has a cracking pressure of less than 0.1 psi. In some embodiments, the vent valve has a cracking pressure of less than 0.05 psi. In some embodiments, the vent valve has a cracking pressure of between about 0.05 psi and about 0.5 psi. In some embodiments, the vent valve has a cracking pressure of between about 0.05 psi and about 0.4 psi. In some embodiments, the vent valve has a cracking pressure of between about 0.06 psi and about 0.3 psi. In some embodiments, the vent valve has a cracking pressure of between about 0.07 psi and about 0.2 psi. In some embodiments, the vent valve has a cracking pressure of between about 0.1 psi and about 0.2 psi.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A foam pump comprising:

a liquid pump chamber;

the liquid pump chamber defined at least in part by a housing; a liquid inlet valve and a liquid outlet valve;

a liquid piston moveable within the liquid pump chamber;

an air pump chamber;

an air pump piston movable within the air pump chamber;

wherein when in use, compression of the liquid pump chamber and the air pump chamber causes liquid and air to be mixed together and dispensed from the foam pump in the form of a foam;

an air vent chamber;

the air vent chamber defined at least in part by a housing; an air inlet valve and an air outlet valve;

an air vent piston movable within the air vent chamber;

wherein when in use, movement of the air vent piston in the air vent chamber to compress the volume of the air vent chamber causes the air inlet valve to open allowing air to flow into a container secured to the foam pump and wherein sufficient vacuum pressure in a container connected to the foam pump will cause the air inlet valve to open allowing air to flow into the container.

2. The foam pump of claim 1 wherein an air outlet of the air vent chamber is located above a liquid inlet of the liquid pump chamber.

3. The foam pump of claim 1 wherein the air vent piston has a piston stem and a shuttle valve.

4. The foam pump of claim 3 wherein the shuttle valve comprises an opening through a center, wherein the opening is larger than a portion of the piston stem.

5. The foam pump of claim 3 wherein the shuttle valve has one or more openings in the surface of the shuttle valve configured to allow air to flow past.

6. The foam pump of claim 3 wherein the piston stem comprises a seat for engaging a surface of the shuttle valve to close the shuttle valve.

7. The foam pump of claim 3 wherein the shuttle valve includes a pressure relief member.

8. The foam pump of claim 1 wherein the air vent chamber is in fluid communication with the air pump chamber.

9. The foam pump of claim 1 wherein the air vent outlet valve is configured to open when a selected vacuum pressure is developed in a container.

10. The foam pump of claim 3 wherein when the shuttle valve is in a first position, air can flow past the shuttle valve and when the shuttle valve is in a second position, air does not flow past the shuttle valve.

11. The foam pump of claim 1 wherein the liquid pump chamber and the air vent chamber have about the same volume.

12. The foam pump of claim 1 wherein the liquid pump chamber has a greater volume than the air vent chamber.

13. The foam pump of claim 1 wherein the foam pump is configured to vent a container using positive pressure when the air vent piston compresses the air vent chamber and is configured to vent the container if a selected vacuum pressure is in the container.

14. A pump comprising:

a liquid pump chamber;

a liquid piston;

a first air pump chamber;

a first air piston;

a mixing area in fluid communication with the liquid pump chamber and the first air pump chamber;

a second air pump chamber;

a second air pump piston;

the second air pump chamber configured for pumping air into a container;

wherein the first air piston and the second air piston move in unison.

15. The pump of claim 14 further comprising a vent valve in fluid communication with the second air pump chamber.

16. The pump of claim 15 wherein the vent valve is configured to open when a selected vacuum pressure is developed in a container.

17. The pump of claim 14 wherein the second air pump piston comprises a shuttle valve.

18. The pump of claim 17 wherein when the shuttle valve is in a first position, air can flow past the shuttle valve into the second air pump chamber and when the shuttle valve is in a second position, air does not flow past the shuttle valve.

19. A refill unit comprising:

a container;

a pump secured to the container;

the pump having a liquid pump chamber;

a liquid pump piston;

a first air pump chamber;

a first air pump piston;

a mixing area downstream of the liquid pump chamber and the first air pump chamber for receiving liquid from the liquid pump chamber and air from the first air pump chamber;

an outlet downstream of the mixing area for dispensing a liquid and air mixture;

a second air pump chamber;

a second air pump piston;

a vent valve secured to the second air pump chamber;

wherein the second air pump chamber has a volume that is about the same volume as the liquid pump chamber; and wherein the second air pump chamber pumps air into the container.

20. The refill unit of claim 19 wherein the vent valve is configured to open when the volume of the second air pump chamber is compressed and is configured to open when the vacuum pressure in the container is greater than the cracking pressure of the vent valve.

* * * * *